US007338296B2

(12) United States Patent
Suzuki

(10) Patent No.: US 7,338,296 B2
(45) Date of Patent: Mar. 4, 2008

(54) ELECTRIC APPARATUS HAVING PLURAL ELECTRIC PARTS

(75) Inventor: Hirohisa Suzuki, Nishio (JP)

(73) Assignee: Anden Co., Ltd., Anjo (JP)

( * ) Notice: Subject to any disclaimer, the term of this patent is extended or adjusted under 35 U.S.C. 154(b) by 196 days.

(21) Appl. No.: 11/237,855

(22) Filed: Sep. 29, 2005

(65) Prior Publication Data

US 2006/0087310 A1 Apr. 27, 2006

(30) Foreign Application Priority Data

Oct. 21, 2004 (JP) ..... 2004-306775

(51) Int. Cl.
*H01R 12/00* (2006.01)

(52) U.S. Cl. ..... 439/76.2

(58) Field of Classification Search ..... 439/76.2, 439/949, 34, 212; 335/83, 202
See application file for complete search history.

(56) References Cited

U.S. PATENT DOCUMENTS 4,603,930 A * 8/1986 Ito ..... 439/78
5,023,752 A * 6/1991 Detter et al. ..... 361/752
5,618,186 A * 4/1997 Saka et al. ..... 439/76.2
6,325,640 B1 * 12/2001 Kasai ..... 439/76.2
6,686,821 B2 2/2004 Suzuki ..... 335/128

FOREIGN PATENT DOCUMENTS

JP A 2002-343216 11/2002

* cited by examiner

*Primary Examiner*—Javaid H. Nasri
(74) *Attorney, Agent, or Firm*—Oliff & Berridge, PLC

(57) ABSTRACT

In an electric apparatus having a bus bar, a plurality of electric parts and a number of terminals connected to external terminals are mounted on the bus bar. The terminals are arranged in two or more lines, plural terminals are arranged in each line. Therefore, a stability and strength in mounting the apparatus to a junction block is improved compared to an apparatus where the terminals are arranged in a single line. The electric apparatus according to the present invention can be mounted to a junction block by being supported with only the terminals of the apparatus.

5 Claims, 4 Drawing Sheets

ELECTRIC APPARATUS HAVING PLURAL ELECTRIC PARTS

CROSS REFERENCE TO RELATED APPLICATION

This application is based on Japanese Patent Application No. 2004-306775 filed on Oct. 21, 2004, the contents of which are incorporated herein by reference in its entirety.

FIELD OF THE INVENTION

The present invention relates to an electric apparatus, in which a plurality of electric parts are mounted to a single bus bar to form a module. Electrical connections between the electric parts and an exterior are performed through terminals extended from the module. The electric apparatus is suitable for automobiles.

BACKGROUND OF THE INVENTION

In a conventional electric apparatus having plural electromagnetic relays mounted to a single bus bar, a number of terminals to be connected to external terminals are mounted to the bus bar and the terminals are arranged in a single line (e.g. JP-A-2002-343216, which is corresponding to U.S. Pat. No. 6,686,821 B2).

To reduce a width dimension of the apparatus (i.e., a dimension in the terminal arrangement direction), terminals made as thin as possible are used for terminals (e.g., coil terminals), through which a relatively small electric current flows.

When the electric apparatus is used for a vehicle, the electric apparatus is attached to a junction block. In this case, since many terminals are arranged in the single line, there is a problem that a sufficient stability or strength in mounting can not be obtained if the electric apparatus is supported by the terminals only. Therefore, a fixed member engaging with the junction block, is required to be provided in a housing of the electric apparatus to secure the sufficient stability and strength in mounting.

Furthermore, the thin terminals are difficult to connect with tuning-fork-shaped terminals (U-shaped terminals) used in the junction block. Therefore, the thin terminals are not suitable for the electric apparatus to be mounted to the junction block.

SUMMARY OF THE INVENTION

In view of the above-described problems, it is an object of the present invention to provide an electric apparatus having plural electric parts, which can be stably supported to a junction block without providing a fixed member in a housing of the apparatus.

An electric apparatus according to the present invention includes a plurality of electric parts mounted to a single bus bar, and a number of terminals to be connected to external terminals. The terminals are arranged on the bus bar in two or more lines and plural terminals are arranged in each line.

Compared to an electric apparatus, in which the terminals are arranged in a single line, the electric apparatus according to the present invention improves a stability and strength when the electric apparatus is mounted to a junction block, since the terminals are arranged in two or more lines and the plural terminals are arranged in each line. Therefore, the electric apparatus can be mounted to the junction block by being supported stably with the terminals only.

By taking this structure, in which the number of terminals are arranged in two or more lines, it becomes possible to use a terminal having a larger width without increasing a width dimension in the terminal arrangement direction. Therefore, the terminals can be connected to tuning-fork-shaped terminals of the junction block. Thus, the electric apparatus is suitably mounted to the junction block.

In the electric apparatus, the terminals in a first line are arranged offset from the terminals in a second line adjacent to the first line, in a terminal arrangement direction on each line. Therefore, the terminals of both the first and second lines are arranged in a zigzag shape.

Therefore, thicker external terminals to be connected to the terminals can be used, since areas around the terminals can be more spacious. As a result, heat generated by the electric parts can be effectively conducted and released to an outside through the thicker external terminals. Therefore, the apparatus is suitable for mounting electromagnetic relays, which generate a large amount of heat.

Since the terminals on the adjacent two lines are arranged alternately in the terminal arrangement direction, the apparatus according to the present invention can be mounted to the junction block from a terminal arranged at the end by slightly inclining the electric part, a positioning of the terminals at the time of mounting becomes easier. Also, the electric apparatus can be mounted to the junction block with a smaller insertion force in total, because the terminals can be inserted one by one.

In the electric apparatus, the terminals in the second line are bent perpendicularly with respect to a longitudinal direction of the terminals of the first line to form first bent portions. The first bent portions of the terminals of the second line are further bent along the longitudinal direction of the terminals of the first line to form second bent portions. By taking this structure, a number of terminals can be mounted to a single bus bar in two or more lines.

In the electric apparatus, a part of the bus bar is covered by a resin-molded member, and the first bent portions of the terminals of the second line are also covered by resin-molded members. Therefore, the second bent portions of the terminals of the second line, which serve as connecting parts with the external terminals, are restrained from moving with respect to the terminals of the first line.

The terminals of the first line and the second line can be positioned at different points in the terminal arrangement direction. Therefore, the apparatus can be stably mounted to the junction block.

BRIEF DESCRIPTION OF THE DRAWINGS

The above and other objects, features and advantages of the present invention will become more apparent from the following detailed description of preferred embodiments made with reference to the accompanying drawings, in which.

DETAILED DESCRIPTION OF PREFERRED EMBODIMENTS

An embodiment of an electric apparatus of the present invention will be typically explained with reference to accompanying drawings.

The electric apparatus contains electromagnetic relays inside the apparatus, and can be used for controlling an electric current conduction of vehicular electric devices such as a head lamp or a wiper motor (neither shown), for example. An up-down direction indicated by the arrows in the accompanying figures shows an arrangement direction of the electric apparatus in the vehicle.

The electric apparatus has a bus bar 1 formed by press-punching a copper plate, and a part of the bus bar 1 is covered by a resinous layer 2. The resinous layer 2 is formed by resin-molding.

Figure 4:
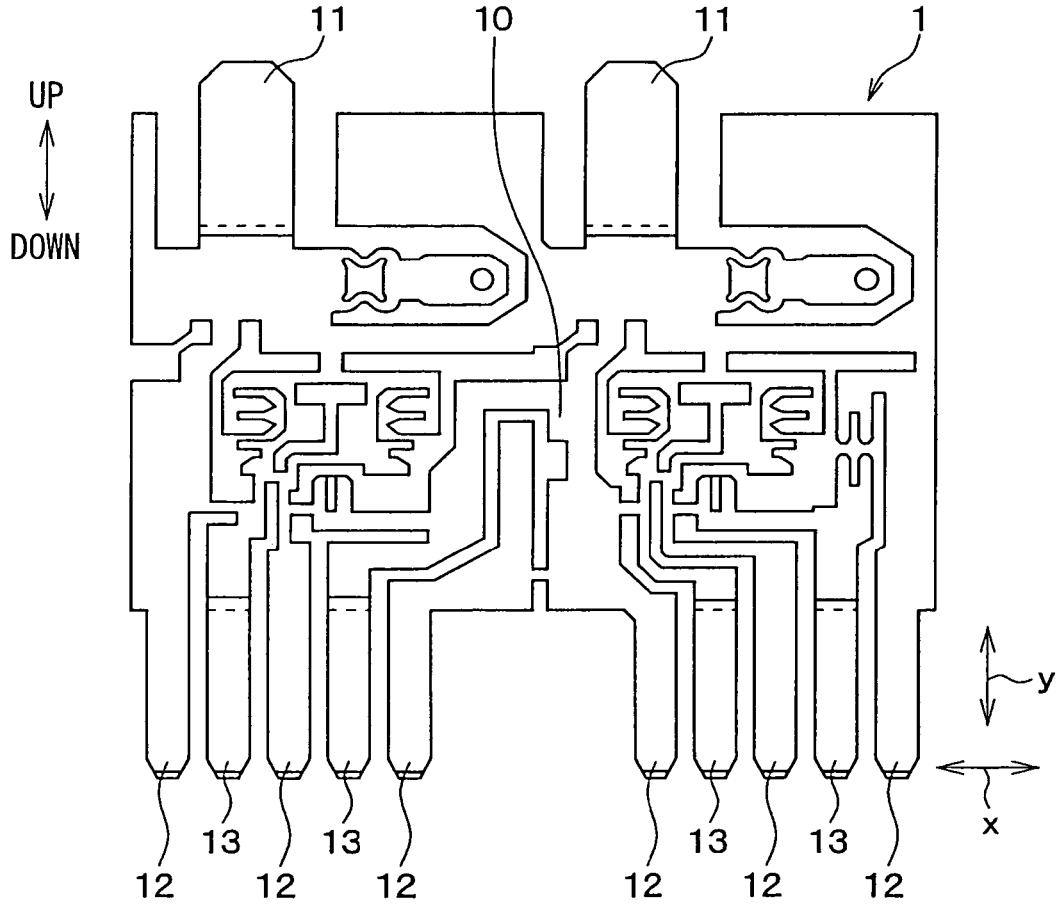
FIG. 4 is a front view of a bus bar of FIG. 2A.

As shown in FIG. 4, a predetermined wiring pattern (a circuit pattern) is formed on the bus bar 1. The bus bar 1 also includes a main body 10 to which electromagnetic relays 3 are mounted, two fuse terminals 11 projecting from the main body 10 and to be connected to a fusible link (not shown), and a number of connecting terminals 12 and 13 to be connected to the vehicular electric devices via a junction block 100 shown in FIG. 2B. The connecting terminals 12 and 13 are all same sized. In this embodiment, two electromagnetic relays 3 and ten connecting terminals 12 and 13 are provided on the bus bar 1, as an example.

Figure 1:
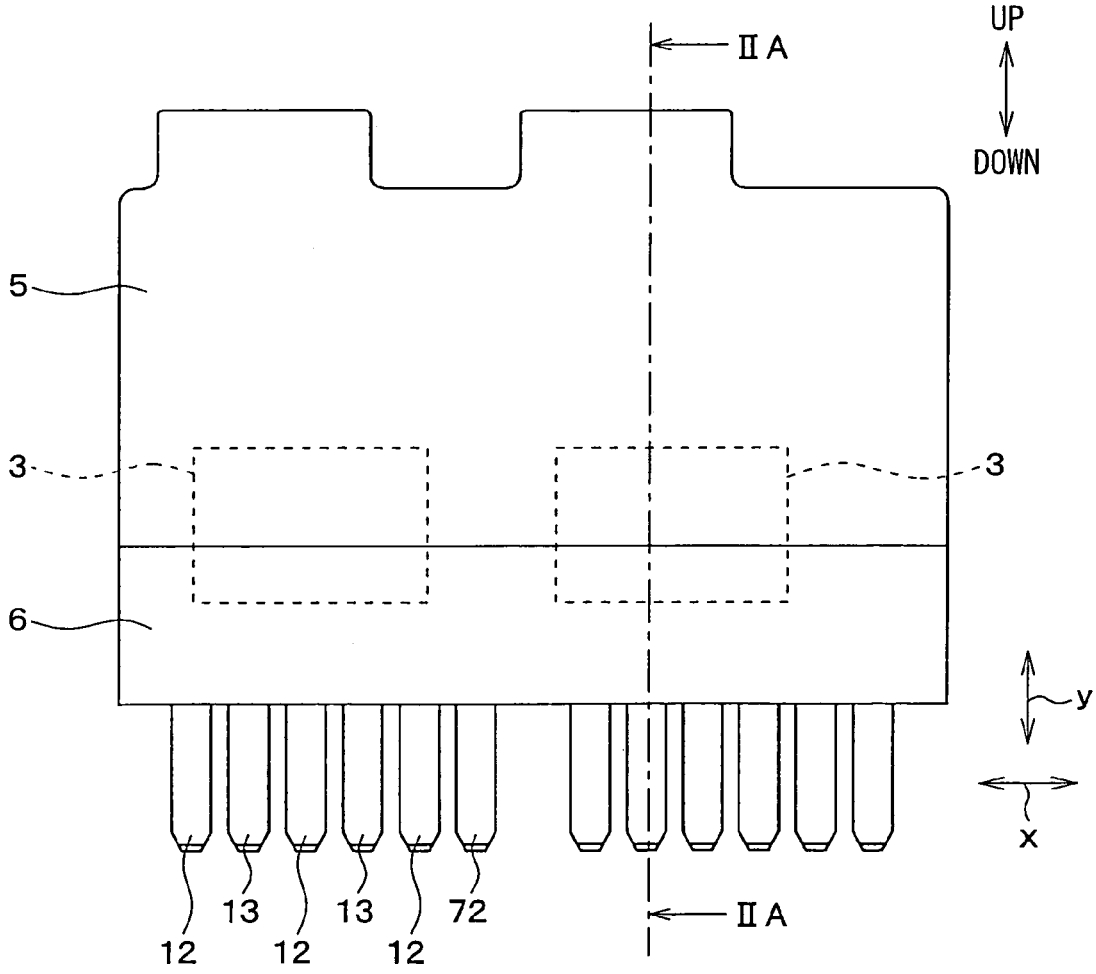
FIG. 1 is a schematic front view showing a structure of an electric apparatus according to an embodiment of the present invention.
Figure 2A:
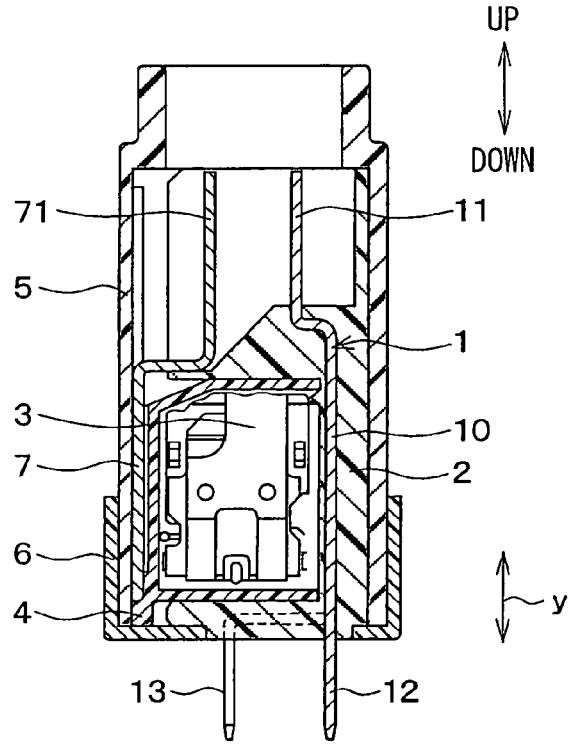
FIG. 2A is a cross-sectional view of the electric apparatus taken along the line IIA-IIA in FIG. 1.
Figure 2B:
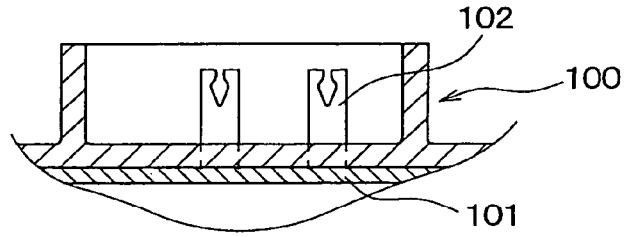
FIG. 2B is a cross-sectional view of a junction block.

The junction block 100 shown in FIG. 2B is for relaying an electricity between the electric apparatus and the vehicular electric devices. The junction block 100 in this embodiment is provided with a bus bar 101 having a number of tuning-fork-shaped connecting terminals 102.

Figure 3:
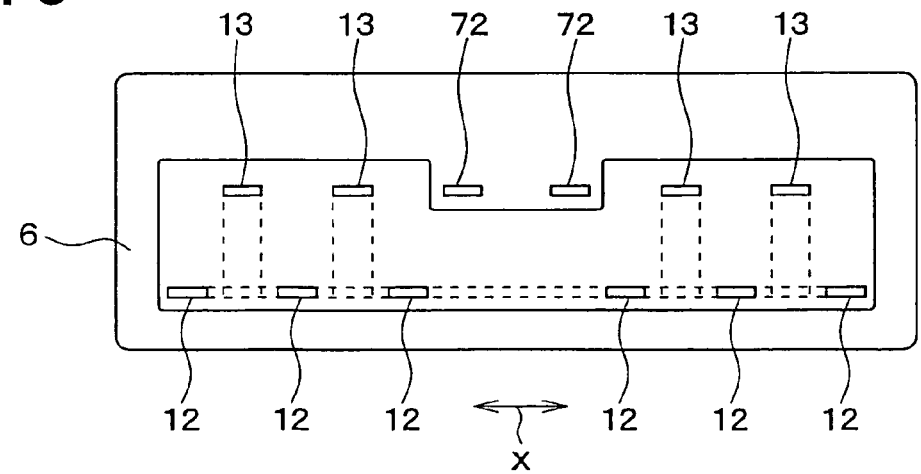
FIG. 3 is a bottom view of FIG. 1.

The connecting terminals 12 and 13 are arranged on the bus bar 1 in two lines as shown in FIG. 3. In the example of FIG. 3, six connecting terminals 12 are provided in a first line and four connecting terminals 13 are provided in a second line. When an arrangement direction of the connecting terminals 12 and 13 in each line is set as x, the connecting terminals 12 and 13 are offset from each other in the direction x. That is, the connecting terminals 12 and 13 on the first and second lines are alternately arranged in the direction x to form a zigzag arrangement. Therefore, the arrangement points of the connecting terminals 12 on the first line are different from the arrangement points of the connecting terminals 13 on the second line in the direction x.

Figure 5:
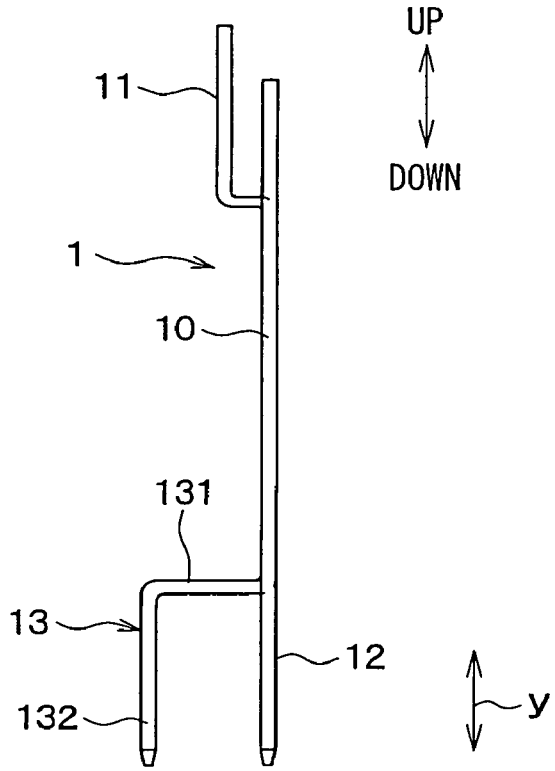
FIG. 5 is a side view of FIG. 4 viewed from a right-hand direction.
Figure 6:
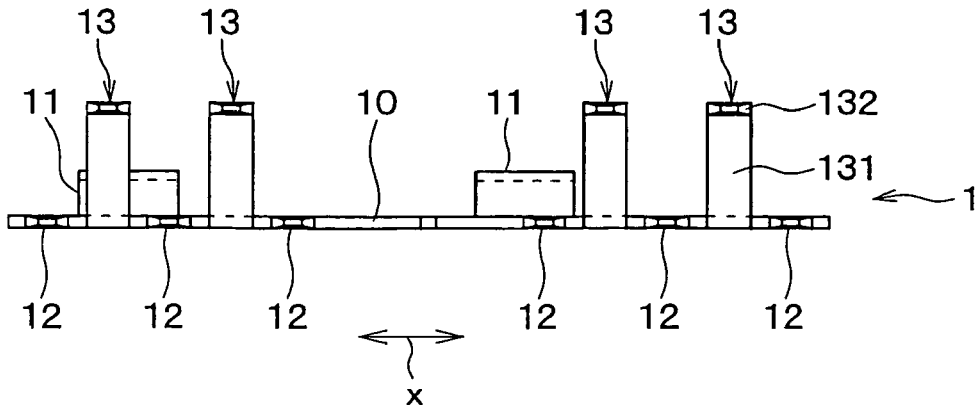
FIG. 6 is a bottom view of FIG. 4.

Each connecting terminal 13 of the second line has a bent portion 131 bent perpendicularly to a longitudinal direction y of the connecting terminals 12 of the first line as shown in FIGS. 5 and 6. An end portion of the bent portion 131 is further bent along the longitudinal direction y of the connecting terminals 12 of the first line so as to form a terminal portion 132. The bent portion 131 is covered by the resinous layer 2 as shown in FIG. 2A.

The electromagnetic relays 3 are for driving a movable contact member by an electromagnetic power of an electromagnetic coil, thereby the movable contact member comes into contact with and separate from a fixed contact member. As a result, a conducting circuit of the vehicular electric device is switched. The electromagnetic relays 3 are equivalents of the electric parts of the electric apparatus.

A resinous cover 4 covering the electromagnetic relays 3 is attached to the bus bar 1. The cover 4 is substantially box-shaped having an opening to the side of the bus bar 1. The electromagnetic relays 3 are contained in a relay containing space, which is defined by the cover 4 and the bus bar 1.

The bus bar 1, the cover 4, and other components are contained in a first housing 5 and a second housing 6. In the upper side of the first housing 5, the fuse terminals 11 of the bus bar 1 and a fuse terminal 71 of a bus bar 7 for a power source are arranged. In the lower side of the second housing 6, all the connecting terminals 12 and 13 of the bus bar 1 and a connecting terminal 72 of the bus bar 7 for the power source are arranged.

The bus bar 7 for the power source is formed by press-punching a copper or a copper group metal plate, and has two fuse terminals 71 connected to the fusible link or to the fuse. The bus bar 7 also has two connecting terminals 72 for the power source to be connected to a vehicular power source via a bus bar 101 of the junction block 100.

The electric apparatus having the above-described structure is attached to the junction block 100 by inserting the connecting terminals 12 and 13 of the bus bar 1 into insertion portions of the connecting terminals 102 of the junction block 100.

The connecting terminals 12 and 13 are arranged on the bus bar 1 in two lines, and plural connecting terminals are arranged in each line. Therefore, a stability and strength in mounting the apparatus to the junction block 100 is improved compared with a case where a number of connecting terminals are arranged in a single line. According to this embodiment, the electric apparatus can be stably mounted to the junction block 100 by only using the connecting terminals 12 and 13.

Since the connecting terminals 12 and 13 are arranged in two lines, it becomes possible to use a terminal having a larger width without increasing a dimension in the width direction (i.e., a dimension in the terminal arrangement direction x) of the apparatus. Further, because the connecting terminals 12 and 13 having a large width can be connected with the tuning-fork-shaped connecting terminals 102 of the junction block 100, the apparatus can be more stably mounted to the junction block 100.

Since the connecting terminals 12 in the first line and the connecting terminals 13 in the second line are alternately arranged in a zigzag shape along the direction x, areas around the connecting terminals 12 and 13 can be made more spacious. As a result, the connecting terminals 102 of the junction block 100 to be connected to the connecting terminals 12 and 13 can be made thicker, thereby heat generated from the electromagnetic relays 3 can be effectively released to an outside through the thicker connecting terminals 102 of the junction block 100.

The connecting terminals 13 in the second line are bent perpendicularly to a longitudinal direction y of the connecting terminals 12 in the first line, and the end portion of the bent connecting terminals 13 is further bent along the longitudinal direction y of the connecting terminals 12 of the first line. Therefore, two lines of the connecting terminals 12 and 13 can be easily arranged on the single bus bar 1.

The terminal portions 132 of the connecting terminals 13 in the second line can be restrained from moving, because the bent portions 131 of the connecting terminals 13 in the second line are fixed by a resin-molded portion.

Also, the electric apparatus can be accurately attached to the junction block 100, because the arrangement of the connecting terminals 12 in the first line and the connecting terminals 13 in the second line is non-point-symmetric.

OTHER EMBODIMENTS

In the above-described embodiment, the connecting terminals 12 and 13 are arranged in two lines, however the connecting terminals on the bus bar 1 can be arranged in three lines or more.

In the above-described embodiment, the electric apparatus having two electromagnetic relays 3 has been explained. However, the present invention can be applied to an electric apparatus having three or more electromagnetic relays 3.

In the above-described embodiment, the electric apparatus having the electromagnetic relays 3 has been explained. However, the present invention can apply to an electric apparatus having other electric parts except for the electromagnetic relays 3.

While the invention has been described with reference to preferred embodiments thereof, it is to be understood that the invention is not limited to the preferred embodiment and constructions. The invention is intended to cover various modification and equivalent arrangements. In addition, while the various elements of the preferred embodiment are shown in various combinations and configurations, which are preferred, other combinations and configuration, including more, less or only a single element, are also within the spirit and scope of the invention.

What is claimed is:

1. An electric apparatus comprising:

a single bus bar that extends continuously;

a plurality of electric parts mounted to the single continuous bus bar; and a number of terminals provided in the single continuous bus bar to be connected to external terminals, wherein the number of terminals are arranged on the single continuous bus bar in two or more lines, and a plurality of the terminals are arranged in each line, wherein the terminals in a first line are arranged offset from the terminals in a second line adjacent to the first line in a terminal arrangement direction on each line, the terminals in the second line are bent perpendicularly with respect to a longitudinal direction of the terminals of the first line to form first bent portions, and the first bent portions of the terminals of the second line are further bent along the longitudinal direction of the terminals of the first line to form second bent portions, and the terminals in the first line and the terminals in the second line are provided in the single continuous bus bar.

2. The electric apparatus according to claim 1, wherein the terminals of both the first and second lines are arranged in a zigzag shape.

3. The electric apparatus according to claim 1, wherein:

a part of the single continuous bus bar is covered by a resin-molded member; and the first bent portions of the terminals of the second line are covered by resin-molded members.

4. The electric apparatus according to claim 1, wherein the terminals in the first line and the terminals in the second line are positioned at different points in a terminal arrangement direction on each line.

5. The electric apparatus according to claim 1, wherein the electric parts are electromagnetic relays.

* * * * *